US006619924B2

(12) United States Patent
Miller

(10) Patent No.: US 6,619,924 B2
(45) Date of Patent: Sep. 16, 2003

(54) METHOD AND SYSTEM FOR REPLACING A COMPRESSOR BLADE

(75) Inventor: Harold Edward Miller, Glenville, NY (US)

(73) Assignee: General Electric Company, Schenectady, NY (US)

( * ) Notice: Subject to any disclaimer, the term of this patent is extended or adjusted under 35 U.S.C. 154(b) by 85 days.

(21) Appl. No.: 09/682,514

(22) Filed: Sep. 13, 2001

(65) Prior Publication Data

US 2003/0049130 A1 Mar. 13, 2003

(51) Int. Cl.[7] ..... F01D 5/32
(52) U.S. Cl. ..... 416/220 R; 29/889.21
(58) Field of Search ..... 416/220 R; 29/889.21

(56) References Cited

U.S. PATENT DOCUMENTS 3,378,230 A 4/1968 Toomey
4,221,542 A 9/1980 Acres et al.
4,265,595 A 5/1981 Bucy, Jr. et al.
4,451,205 A 5/1984 Honda et al.
4,453,890 A 6/1984 Brantley
4,462,756 A * 7/1984 Muggleworth et al. ..... 416/215
5,431,542 A 7/1995 Weisse et al.
5,540,552 A 7/1996 Surdi
5,584,659 A 12/1996 Schmidt

* cited by examiner

*Primary Examiner*—Edward K. Look
*Assistant Examiner*—Kimya N McCoy
(74) *Attorney, Agent, or Firm*—Hunton & Williams

(57) ABSTRACT

A blade assembly is provided for installation in a rotor wheel slot having a slot neck in communication with a slot base cavity having first and second slot flank walls and a slot floor. The blade assembly comprises a blade element having an airfoil portion and a base portion configured for insertion into the rotor wheel slot through the slot neck. The blade assembly also comprises at least one filler piece configured for insertion into the rotor wheel slot through the slot neck. The at least one filler piece is also configured for positioning intermediate the base portion and the first slot flank wall to secure the base portion within the rotor wheel slot.

32 Claims, 14 Drawing Sheets

METHOD AND SYSTEM FOR REPLACING A COMPRESSOR BLADE

BACKGROUND OF INVENTION

This invention relates to blade elements used in compressor and turbine rotors. More particularly, the invention relates to a blade assembly that can be used to replace damaged blades in the field.

An axial flow compressor comprises a rotor made up of a plurality of wheels attached to a shaft, the wheels providing the compression stages of the compressor. Each compressor wheel is typically an annular disk with a plurality of blade elements attached to its outer rim. The blade elements typically have a blade portion with an airfoil-shaped cross-section and an arrangement for attaching the blade element to the wheel. The attachment arrangement is typically a dovetail-shaped base configured for placement in a correspondingly shaped groove or slot in the wheel.

Compressor rotors rotate at high speeds to compress large volumes of gas. Unfortunately, the gas entering the intake of the compressor may sometimes include solid matter. The compressor blades are therefore subject to occasional damage due to high speed collision with solid particles. Such foreign object damage (FOD) can be severe enough that the damaged blade must be machined or replaced. The components of early (i.e., low pressure) stage compressor wheels/blades are often large enough that damaged blades may be machined in place. Later stage blades, however, typically require removal. Depending on the configuration of the blade attachment arrangement, this can require removal and disassembly of the entire wheel.

SUMMARY OF INVENTION

The present invention provides a replacement blade assembly that allows the replacement of damaged blade elements without removal and disassembly of the rotor.

Accordingly, the present invention provides a blade assembly for installation in a rotor wheel slot having a slot neck in communication with a slot base cavity defined by first and second slot flank walls and a slot floor. The blade assembly comprises a blade element having an airfoil portion and a base portion configured for insertion into the rotor wheel slot through the slot neck. The blade assembly also comprises at least one filler piece configured for insertion into the rotor wheel slot through the slot neck. The at least one filler piece is also configured for positioning intermediate the base portion and the first slot flank wall to secure the base portion within the rotor wheel slot.

The base portion of the blade element of a blade assembly according to the invention may include a base dovetail having first and second dovetail flank surfaces and a dovetail bottom surface. The blade assembly may comprise a first filler piece configured to be positionable with at least a portion of the first filler piece disposed intermediate the first dovetail flank surface and the first slot flank wall. The blade assembly may further comprise a second filler piece configured so that at least a portion of the second filler piece is disposable intermediate the second dovetail flank surface and the second slot flank wall. The at least a portion of the first filler piece may include a first engaging surface adapted for engaging the first slot flank wall and a second engaging surface adapted for engaging the first dovetail flank surface. The at least a portion of the second filler piece may include a third engaging surface adapted for engaging the second slot flank wall and a fourth engaging surface adapted for engaging the second dovetail flank surface. The first and second filler pieces may each include a bottom member configured so that the bottom member is disposed intermediate the dovetail bottom surface and the slot floor. At least a portion of the bottom member may be configured to engage the dovetail bottom surface and the slot floor.

In an embodiment of the invention, the base portion of the blade element may include a base dovetail having first and second dovetail flank surfaces and a dovetail bottom surface. The blade assembly may comprise a first plurality of filler pieces sized and configured to be positionable with at least a portion of each of the first plurality of filler pieces disposed intermediate the first dovetail flank surface and the first slot flank wall. A second plurality of filler pieces may be sized and configured to be positionable with at least a portion of each of the second plurality of filler pieces disposed intermediate the second dovetail flank surface and the second slot flank wall. The at least a portion of each of the first plurality of filler pieces may include a first engaging surface adapted for engaging the first slot flank wall and a second engaging surface adapted for engaging the first dovetail flank surface. The at least a portion of each of the second plurality of filler pieces may include a third engaging surface adapted for engaging the second slot flank wall and a fourth engaging surface adapted for engaging the second dovetail flank surface. Each of the first and second plurality of filler pieces may include a bottom member configured so that the bottom member is disposed intermediate the dovetail bottom surface and the slot floor. The at least a portion of the bottom member may be configured to engage the dovetail bottom surface and the slot floor.

Embodiments of the blade assembly of the invention may comprise a spacer configured for insertion into the rotor wheel slot through the slot neck. The spacer may be further configured for positioning within the rotor wheel slot in abutment with the base portion of the blade element. The spacer may have a spacer dovetail with first and second spacer flank surfaces configured for engagement with the first and second slot flank walls. The blade assembly may further comprise means for securing the spacer in place within the rotor wheel slot. The means for securing may include a threaded fastener having proximal and distal ends. The threaded fastener may be configured for insertion through a corresponding threaded passage in the spacer so that the distal end contacts the floor of the slot dovetail.

An embodiment of the invention provides a blade assembly for installation on a rotor wheel having a blade slot formed in a circumferential rim thereof, the blade slot having a substantially constant cross-section with a slot neck in communication with a slot base cavity having first and second flank surfaces and a floor. The blade assembly comprises a blade element having an airfoil portion and a base portion. The base portion has first and second base flank surfaces and is configured for insertion into the blade slot through the slot neck. The blade assembly further comprises a first filler piece configured to be positionable with at least a portion of the first filler piece disposed intermediate the first base flank surface and the first slot flank wall. The blade assembly also comprises a second filler piece configured so that at least a portion of the second filler piece is disposable intermediate the second base flank surface and the second slot flank wall. At least a portion of the first filler piece may include a first engaging surface adapted for engaging the first slot flank wall and a second engaging surface adapted for engaging the first base flank surface. At least a portion of the second filler piece may include a third engaging surface adapted for engaging the second slot flank wall and a fourth engaging surface adapted for engaging the second base flank surface.

One aspect of the invention provides a blade assembly for installation on a rotor wheel having a blade slot formed in a circumferential rim thereof, the blade slot having a substantially constant cross-section with a slot neck in communication with a dovetail-shaped slot base cavity defined by first and second flank surfaces and a floor. The blade assembly comprises a blade element having an airfoil portion and elongate base portion including a base dovetail having first and second dovetail flank surfaces and a dovetail bottom surface. The base portion is configured for insertion into the blade slot through the slot neck. The blade assembly also comprises a first plurality of filler pieces sized and configured to be positionable with at least a portion of each of the first plurality of filler pieces disposed intermediate the first dovetail flank surface and the first slot flank wall. The blade assembly further comprises a second plurality of filler pieces sized and configured to be positionable with at least a portion of each of the second plurality of filler pieces disposed intermediate the second dovetail flank surface and the second slot flank wall.

One aspect of the invention provides a method of replacing a blade element installed on a rotor wheel having a blade slot formed in a circumferential rim thereof. The blade slot has a substantially constant cross-section with a slot neck in communication with a slot base cavity having first and second slot flank walls and a slot floor. The blade element has an airfoil portion and a blade element base portion disposed within the blade slot. The method comprises removing the blade element from the blade slot and providing a replacement blade element having a replacement blade airfoil portion and a replacement blade element base portion. The replacement blade element base portion is configured for insertion into the blade slot through the slot neck. The replacement blade element base portion also has opposing first and second base ends. The method further comprises inserting the replacement blade element base portion into the blade slot through the slot neck. The method still further comprises providing at least one filler piece configured for insertion into the blade slot through the slot neck and for positioning intermediate the replacement blade element base portion and the first slot flank wall for securing the replacement blade element base portion within the blade slot. A first one of the at least one filler piece is inserted through the slot neck into the blade slot adjacent one of the first and second base ends. The first one of the at least one filler piece is then positioned against the first slot flank wall. The first one of the at least one filler piece is then slid along the first slot flank wall to a position wherein the first one of the at least one filler piece is disposed intermediate the replacement blade element base portion and the first slot flank wall.

A method of replacing a blade element according to the invention may comprise inserting a second one of the at least one filler piece through the slot neck into the blade slot adjacent one of the first and second base ends. The second one of the at least one filler piece is then positioned against the second slot flank wall. The method may further comprise sliding the second one of the at least one filler piece along the second slot flank wall to a position wherein the second one of the at least one filler piece is disposed intermediate the replacement blade element base portion and the first slot flank wall.

A method of replacing a blade element according to the invention may comprise providing a first spacer configured for insertion into the blade slot through the slot neck. The first spacer is further configured for positioning within the blade slot in abutment with the base portion of the blade element. The spacer has a spacer base with first and second spacer flank surfaces configured for engagement with the first and second slot flank walls and a first spacer abutment surface configured for engaging the first base end. The method may further comprise providing means for securing the first spacer in place within the blade slot. The method may also comprise inserting the first spacer through the slot neck into the blade slot adjacent the first base end. The first spacer is then positioned within the blade slot so that the first spacer flank surface engages the first slot flank wall, the second spacer flank engages the second slot flank wall, and the first spacer abutment surface engages the first base end. The first spacer is then secured in position using the means for securing the first spacer. The means for securing the first spacer may include a threaded fastener disposed through a corresponding threaded passage in the first spacer so that rotation of the threaded fastener causes an end of the threaded fastener to engage the slot floor and force the spacer radially outward. The method may further comprise the step of machining a depression in the slot floor to provide a seat for the threaded fastener end.

A method of replacing a blade element according to the invention may comprise providing a second spacer configured for insertion into the blade slot through the slot neck and for positioning within the blade slot in abutment with the base portion of the blade element. The second spacer has a second spacer base with third and fourth spacer flank surfaces configured for engagement with the first and second slot flank walls and a second spacer abutment surface configured for engaging the second base end. The method may further comprise providing means for securing the second spacer in place within the blade slot. The second spacer is inserted through the slot neck into the blade slot adjacent the second base end. The second spacer is then positioned within the blade slot so that the third spacer flank surface engages the first slot flank wall, the fourth spacer flank engages the second slot flank wall, and the second spacer abutment surface engages the second base end. The second spacer is secured in position using the means for securing the second spacer.

The step of removing the blade element from the blade slot in a method of replacing a blade element according to the invention may include removing the airfoil portion of the blade element, grinding out a central portion of the blade element base portion through the slot neck to leave two lateral portions of the blade element base portion in the slot base cavity, and removing the two lateral portions of the blade element base portion from the blade slot through the slot neck.

Other objects and advantages of the invention will be apparent to one of ordinary skill in the art upon reviewing the detailed description of the invention.

BRIEF DESCRIPTION OF DRAWINGS

The present invention can be more fully understood by reading the following detailed description of presently preferred embodiments together with the accompanying drawings, in which like reference indicators are used to designate like elements, and in which.

DETAILED DESCRIPTION

As noted above, the blade elements of a compressor rotor typically have a blade portion with an airfoil-shaped cross-section and an arrangement for attaching the blade element to the wheel. The attachment arrangement is typically a dovetail shaped base configured to fit into a correspondingly shaped slot machined in the outer rim of the wheel. A single dovetail slot may be formed circumferentially around the entire wheel, in which case all of the blade elements are secured by a single slot. Alternatively, multiple slots may be machined across the rim of the wheel with each slot being used to secure one blade element. In this configuration, the dovetail of each blade element is inserted into the slot through the side of the wheel rim. Typically, the blade elements are secured by inserting securing spacers into the groove on either side of the dovetail.

Wheels having a blade element secured in slots formed across the wheel rim have an inherent deficiency with respect to blade replacement. In a compressor rotor made up of such cross-slot wheels, adjacent compressor wheels may be very closely spaced. As a result, once the rotor is assembled, the blade elements and their associated spacers cannot be removed by sliding them out through the slot openings in the sides of the wheels without disassembling the rotor. Because rotor disassembly typically requires complete removal of the rotor, field replacement of the blade elements for rotors of this type has, heretofore, not been possible.

The present invention provides a blade replacement method that allows a standard dovetail-secured blade element of a cross-slot compressor wheel to be replaced without the removal and disassembly of the rotor. This method involves the destruction and removal of a blade element and the insertion of a replacement blade element and a specially designed securing arrangement into the slot. The replacement blade element and the securing arrangement are inserted radially into the slot rather than through the sides of the wheel. As a result, the blade replacement process can be carried out without disassembly of the rotor.

Figure 1:
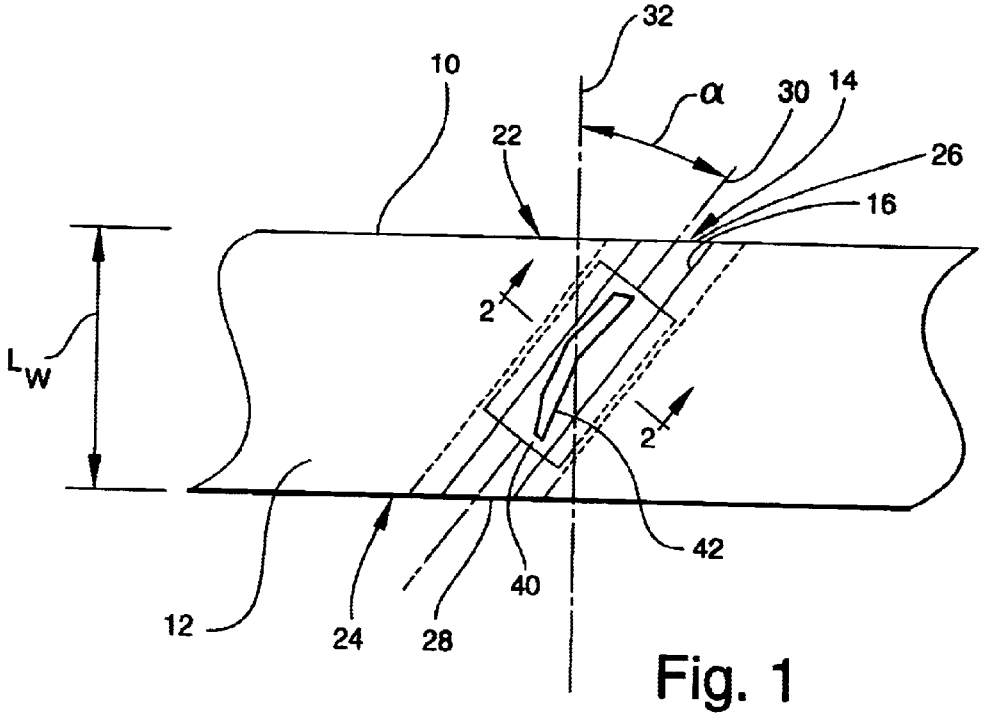
FIG. 1 is a radial view of a portion of a compressor wheel including a standard blade element installed therein.
Figure 2:
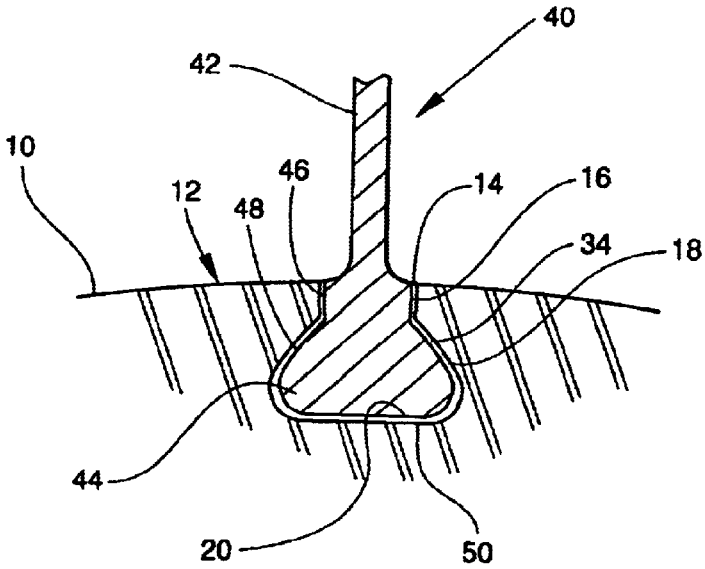
FIG. 2 is a section view of a portion of the compressor wheel and standard blade element illustrated in FIG. 1.

FIGS. 1 and 2 illustrate a portion of the outer rim 12 of an exemplary compressor wheel 10. The compressor wheel 10 includes a plurality of slots 14 in each of which is disposed the base portion 44 of a blade element 40. Each blade element 40 also includes an airfoil portion 42. During manufacture, the base portions 44 of the blade elements 40 are inserted into the slots 14 through one of the slot openings 26, 28 in the sides 22, 24 of the compressor wheel 10. Once positioned within the slot 14, each blade element 40 is secured in place using spacers (not shown) inserted into the slot 14 on opposing sides of the base portions 44.

The compressor wheel 10 has a length dimension $L_W$ that extends from one wheel side 22 to the other wheel side 24 in a direction parallel to the axis of rotation 32 of the wheel 10. The blade slots 14 (for clarity, only one slot 14 is shown) are machined into the rim 12 of the wheel 10, typically by broaching. Each slot 14 is formed to pass entirely through the length $L_W$ of the wheel 10, thus forming slot openings 26, 28. As shown in FIG. 1, the slot 14 is generally formed along a slot axis 30 at an angle $\alpha$ from a line on the rim 12 that is parallel to the axis of rotation 32 of the wheel 10.

The blade slot 14 includes a base cavity 18 that accommodates the base portion 44 of the blade element 40. Typically, both the base cavity 18 and the blade element base 44 are dovetail-shaped but other shapes are possible. The base portion 44 of the blade element 40 and the neck 16 and base cavity 18 of the blade slot 14 are configured so as to restrain the blade element 40 against the rotational forces encountered during operation of the compressor. Specifically, the neck 16 and the cavity flank walls 34 are sized to counter the centrifugal force generated by the mass of the blade element 40. The cavity flanks 34 provide a bearing surface for the blade element base flanks 48 to transmit the centrifugal load to the wheel 10. A typical blade element 40 formed from a 400 series stainless steel may have a mass of about 0.66 Kg (1.45 lbm). For a typical 1.5 m (60 in.) diameter rotor spinning at 3600 rpm, this produces a force on the order of 75,600 N (17,000 lbs.).

As discussed above, the blade elements 40 are installed in the wheel 10 by insertion through one of the side openings 26, 28 in the slot 14. Removal of an intact blade element 40 requires that the blade element 40 be slid out of the slot 40 in a similar manner. Because adjacent wheels of the rotor are typically separated by much less than the length of a blade element, removal of the blade element 40 through the slot opening 26, 28 requires that the rotor be disassembled.

Figure 3:
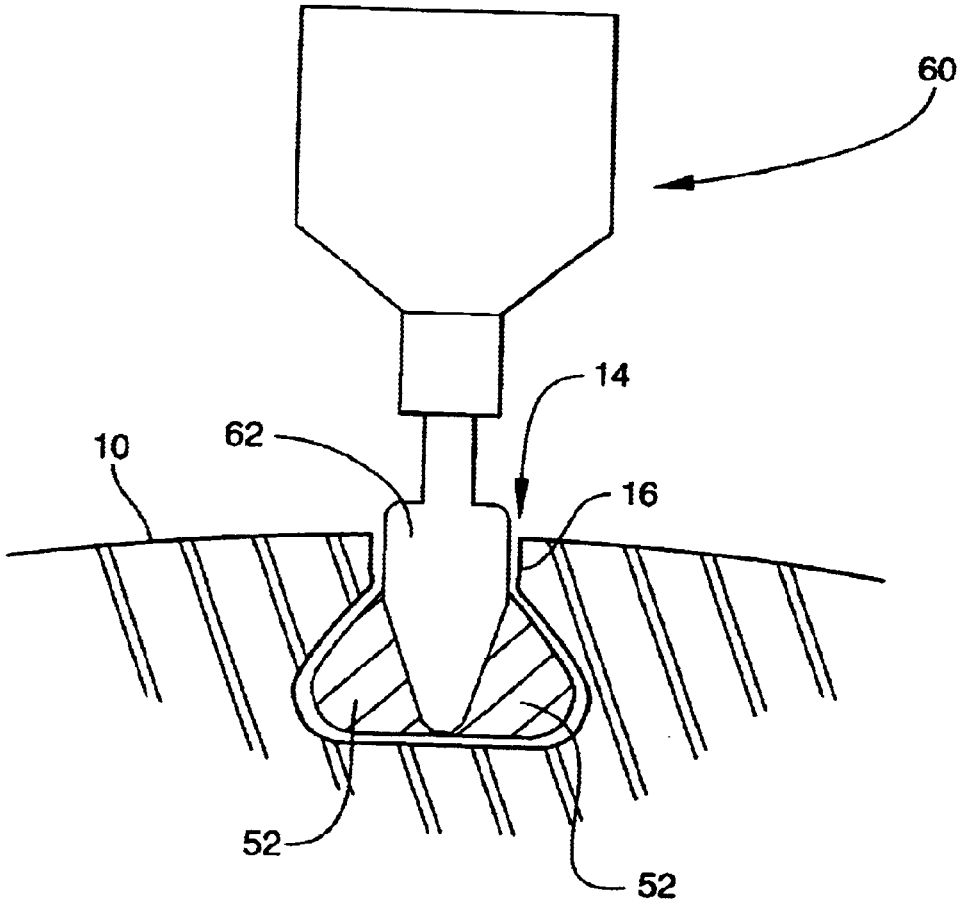
FIG. 3 is a section view of a portion of the compressor wheel illustrated in FIG. 1 illustrating a method of removing the standard blade element.
Figure 4:
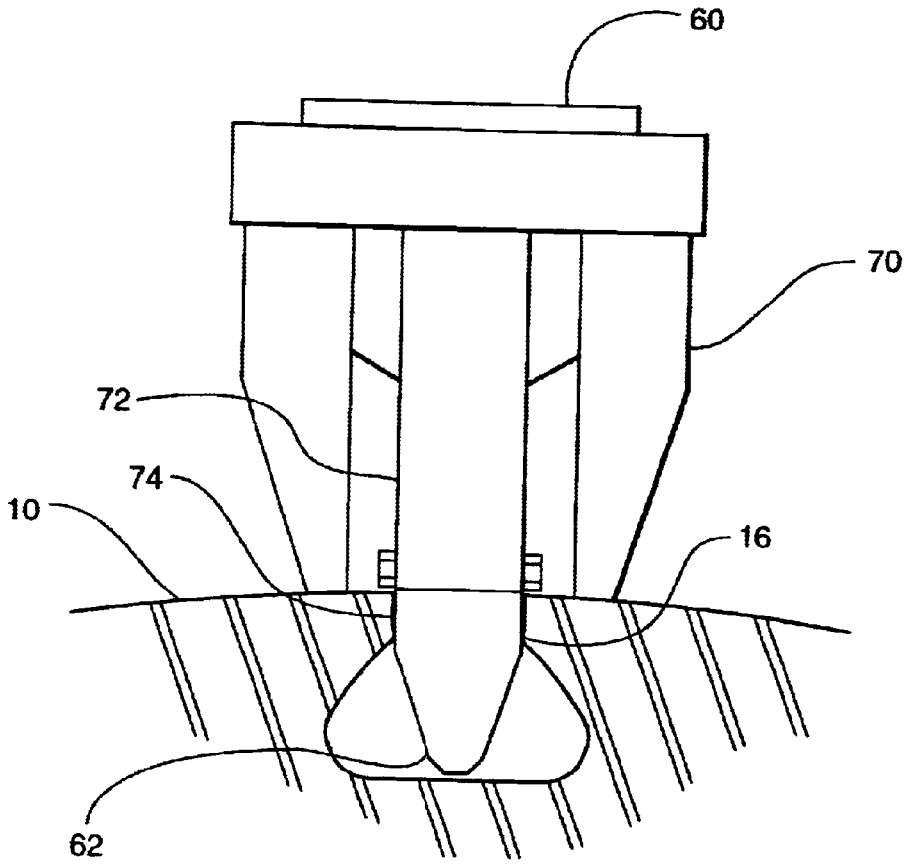
FIG. 4 is a section view of a portion of the compressor wheel illustrated in FIG. 1 illustrating a jig to facilitate the method illustrated in FIG. 3.

The present invention provides for removal and replacement without disassembly. The most likely reason for removal of a blade element 40 is that it has suffered foreign object damage (FOD). In such instances, the blade element 40 is often unsalvageable and therefore need not be removed intact. The present invention therefore contemplates the destructive removal of the blade element 40. As shown in FIG. 3, a grinding tool 60 can be used to grind down the central portion of the blade element 40, leaving only the lateral portions 52 of the base 44. The tool 60 may be selected or configured to leave the slot 14 substantially unchanged. The grinding tool 60 may be any appropriate tool having a head 62 small enough to fit through the neck portion 16 of the slot 14. As shown in FIG. 4, a jig or guide 70 may be attached to the grinding tool 60 to assure proper alignment. Shim stock 74 may be attached to the center guide 72 of the jig 70 to protect the wheel material from inadvertent grinding. The lateral portions 52 of the base 44 that remain after grinding are small enough that they can be removed through the neck portion 16 of the slot 14. The original spacers used to secure the blade element 40 may be removed in a similar manner.

It will be understood by those having ordinary skill in the art that the blade element 40 may be removed using any method or tooling that can be used with the rotor in place and that does not damage the wheel 10 or inadvertently reconfigure the slot 14.

Figure 5:
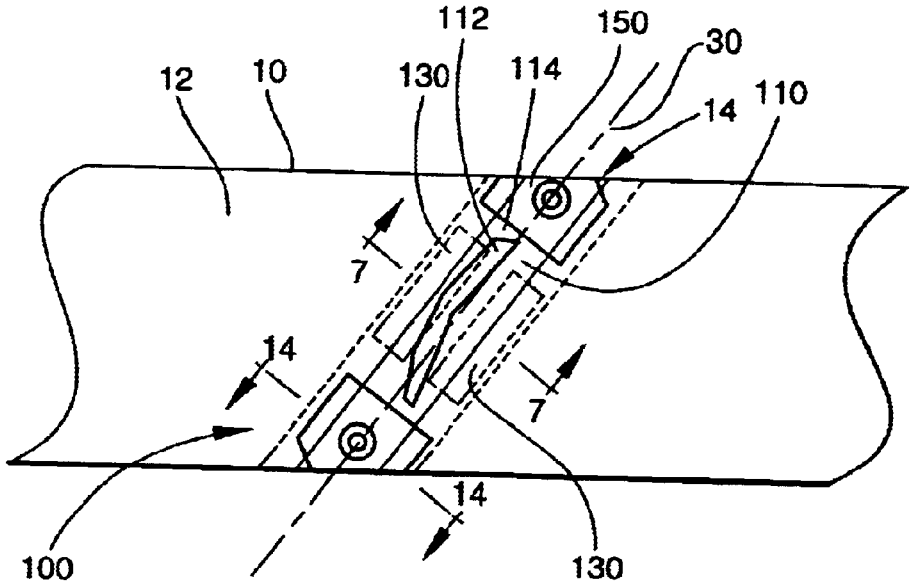
FIG. 5 is a radial view of a portion of a compressor wheel having a replacement blade assembly according to the present invention installed therein.
Figure 6:
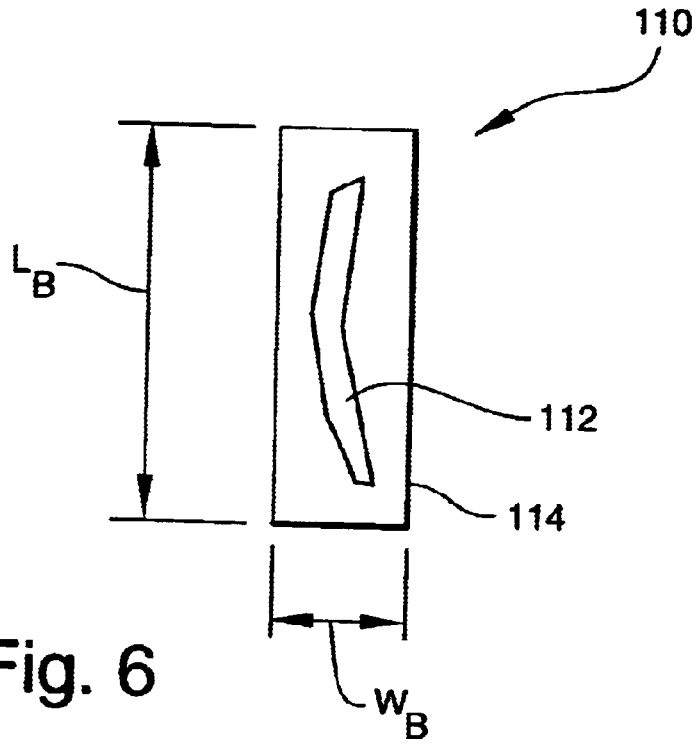
FIG. 6 is a top view of a replacement blade element of the replacement blade assembly illustrated in FIG. 5.
Figure 7:
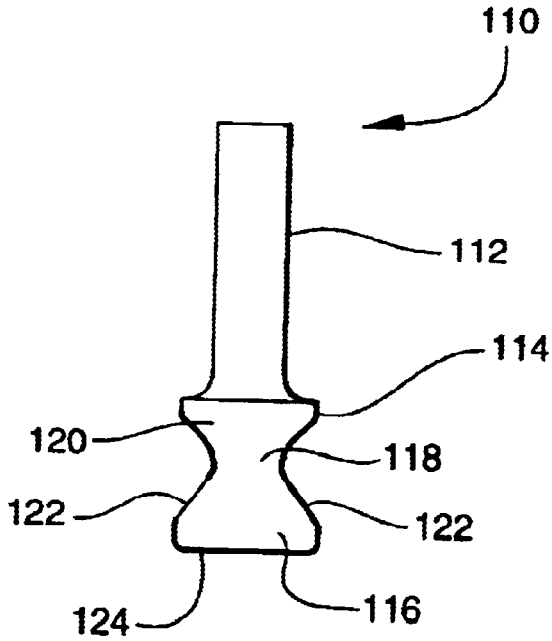
FIG. 7 is an end view of the replacement blade element illustrated in FIG. 6.

Referring now to FIGS. 5–19, a blade replacement assembly 100 according to an embodiment of the invention includes a replacement blade element 110, a plurality of filler pieces 130 and a pair of spacers 150. These components are sized and configured so as to be installed through the neck 16 of the slot 14. As shown in FIGS. 6 and 7, the replacement blade element 110 includes an airfoil portion 112 and a base portion 114 integrally formed as a single unit. The airfoil portion 112 may be formed so as to be aerodynamically substantially similar to the airfoil portion 42 of the original blade element 40. In one common configuration, the base portion 114 has a substantially constant hourglass-shaped cross-section formed by an upper base portion 120, a narrowed neck portion 118 and a lower dovetail portion 116 having base dovetail flanks 122. The base portion 114 is configured to have a maximum width dimension $W_B$ that is smaller than the width dimension of the slot neck 16. This allows the insertion of the base portion 114 of the replacement blade element into the slot 14 in a substantially radial direction (i.e., along a radius of the wheel 10). The base portion also has a length dimension $L_B$.

It will be understood by those of ordinary skill in the art that other base portion configurations may be used depending on the shape of the base cavity 18. The primary requirements are that the base portion is insertable through the slot neck 16 and that it has a flank wall or walls for transmitting a radial load directly to a bearing surface of the base cavity 18 or through a filler piece to a bearing surface of the base cavity 18.

Figure 8:
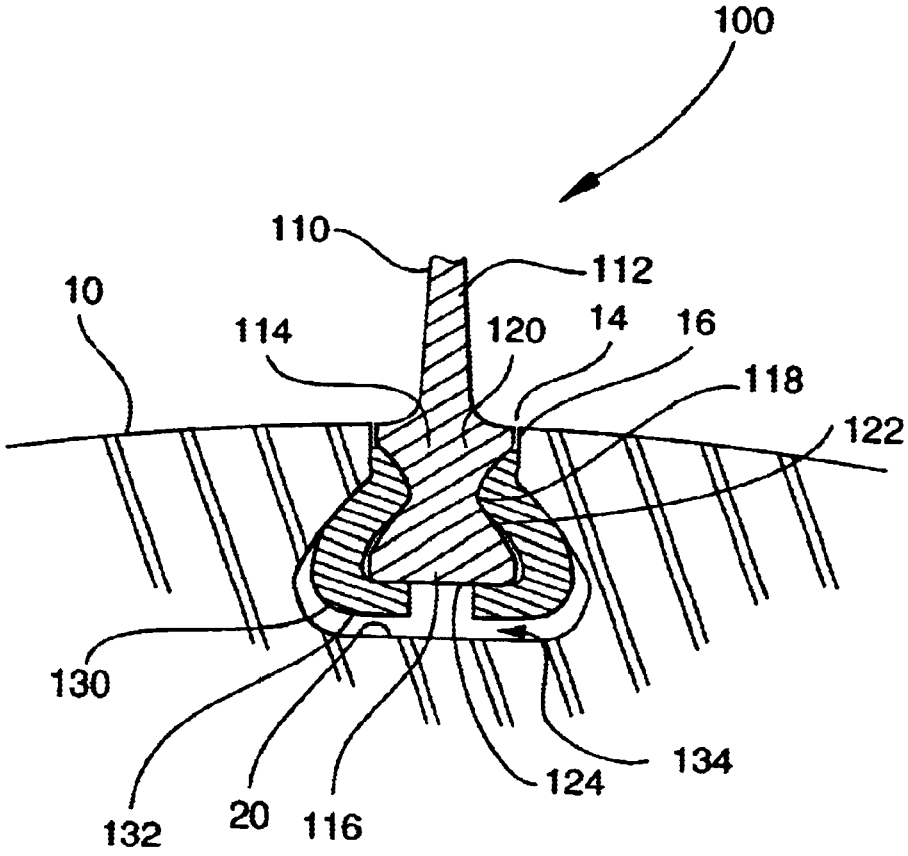
FIG. 8 is a section view of a portion of the compressor wheel and the blade replacement assembly illustrated in FIG. 5.
Figure 9:
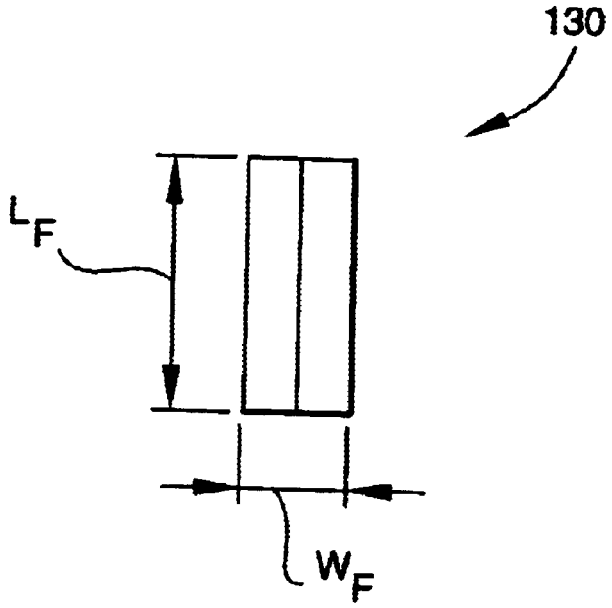
FIG. 9 is a top view of a filler piece of a blade replacement assembly according to the invention.
Figure 10:
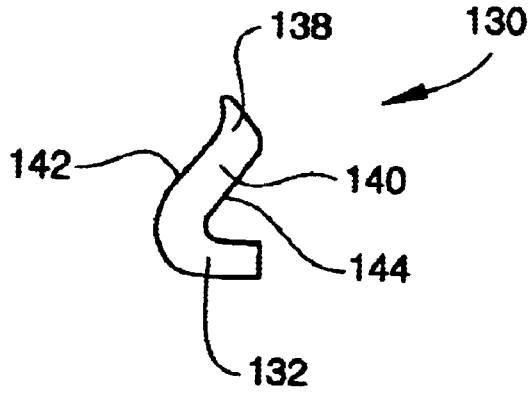
FIG. 10 is an end view of the filler piece illustrated in FIG. 9.

As shown in FIG. 8, the replacement blade element 110 is held in place within the slot 14 by the filler pieces 130. One configuration of the filler pieces 130 is shown in FIGS. 9 and 10. These pieces 130 have a substantially constant cross-section configured to fill the spaces between the base portion 114 of the replacement blade element 110 and the flanks 34 of the base cavity 18 of the slot 14. This cross-section may be somewhat S-shaped to conform to the flanks 34 of the base cavity 18, a portion of the slot neck 16, the flanks 122 of the replacement blade dovetail 116 and the neck portion 118 of the replacement blade base 114. Again, other shapes may be used depending on the slot cavity geometry. As shown in FIG. 10, the S-shaped filler piece 130 has a bottom member 132 and an upper member 138 connected by an angled member 140. The angled member 140 has two substantially flat surfaces 142, 144. The first flat surface 142 is angled to conform to the cavity flank 34 while the second flat surface 144 is angled to conform to the dovetail flank 122. The filler pieces 130 on opposing sides of the replacement blade element base 114 together serve to wedge the replacement blade base 114 within the slot 14.

The filler pieces 130 may be formed from steel similar to the wheel alloy or by nickel alloy as for high temperature blades. Alternatively, titanium may be used in order to reduce the weight of the replacement assembly 100.

For convenience, the replacement blade element base 114 is formed symmetrically. This allows the use of identical filler pieces 130 on both sides of the base dovetail 116. It will be understood that an asymmetric base 114 could also be used and may be preferred, for instance, in cases where slot 14 is asymmetric.

The filler pieces 130 are sized and configured to be inserted into the slot 14 through the slot neck 16. This can be accomplished by forming the filler piece 130 with a maximum width dimension $W_F$ that is less than the width of the slot neck 16. It can also be accomplished by forming the filler piece 130 so that it can be maneuvered through the slot neck 16 by a combination of rotation and translation maneuvers along the S-shaped profile of the filler piece 130.

Figure 11:
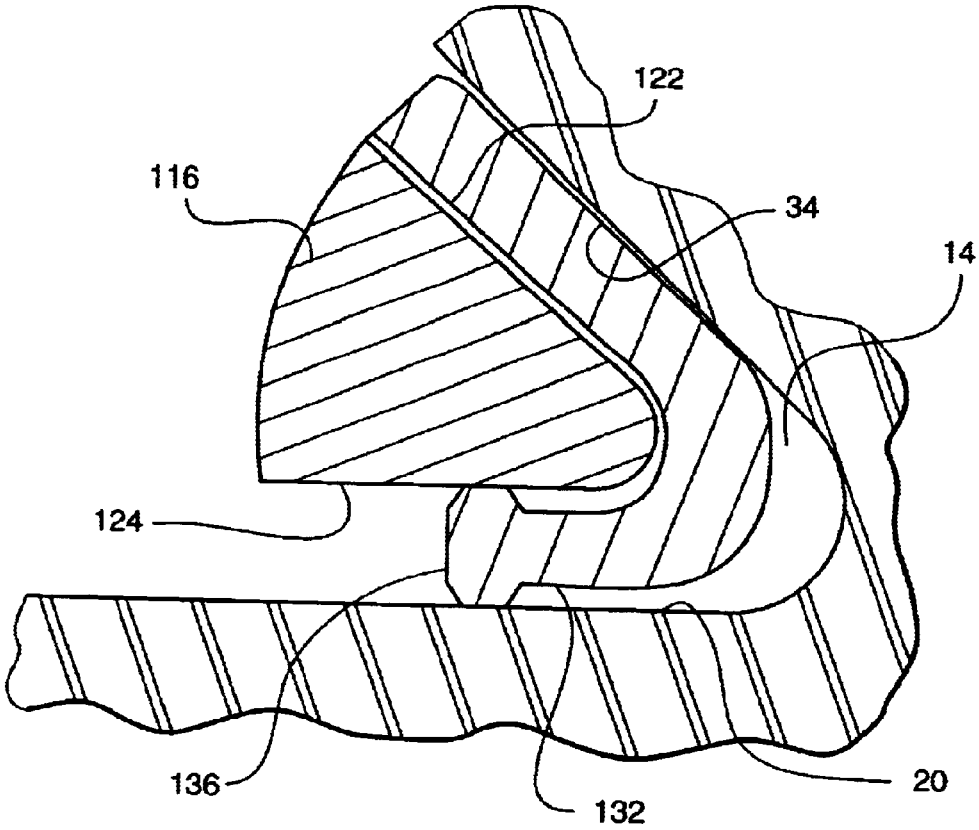
FIG. 11 is a section view of a portion of a compressor wheel and a portion of a replacement blade assembly according to the invention.

The filler pieces 130 may be configured to provide a close fit or an interference fit when positioned between the replacement blade element base 114 and the slot 14. Depending on the geometry of the slot 14 and the filler piece 130, there can be a gap between the bottom 132 of the filler pieces 130 and the slot floor 20. To further secure the filler pieces 130, the filler pieces 130 may be sized so that a portion of the bottoms 132 of the filler pieces 130 spans the gap between the slot floor 20 and the bottom surface 124 of the base 114. This reduces the tendency for the replacement blade element 110 to rock back and forth within the slot 14. Alternatively, in order to minimize weight and reduce the amount of contact surface area, the filler piece bottom 132 may include a flange 136 that contacts the bottom surface 124 of the replacement blade element base dovetail 116 and the slot floor 20, as shown in FIG. 11. This approach reduces the tendency for the replacement blade element 110 to rock but allows the filler pieces 130 to be inserted more easily.

The combination of the replacement blade base 114 and the filler pieces 130 provides an effective dovetail that bears against the flanks 34 of the slot base cavity 18, thereby preventing the replacement blade element 110 from being ejected from the slot 14 by centrifugal forces acting on the mass of the replacement blade element 110. It will be understood, however, that the blade replacement dovetail 116 is significantly smaller than the original blade dovetail 44. One way to assure that the replacement blade element 110 is not ejected is to reduce the centrifugal load by reducing the mass of the replacement blade element 110. This may be accomplished through material selection. The replacement blade element 110 may be formed, for example from a titanium alloy, which would provide approximately twice the strength-to-weight ratio of steel. In low temperature applications, aluminum alloys could be used.

Weight reduction may also be accomplished through the removal of material from areas of the replacement blade element 110 that are less structurally critical. Material could be removed, for example, by making the bottom surface 124 of the replacement blade base 114 concave. Material could also be removed by drilling radial holes in the airfoil portion 112 of the replacement blade element.

Regardless of the weight reduction technique, conventional structural analysis techniques can be used to determine the tradeoff between weight and the dovetail surface required to prevent ejection of the replacement blade element 110. In addition, conventional structural dynamic analysis can be used to factor in effects on natural frequency.

It will be understood that the above conventional design methods can be used to assure that the replacement blade element 110 and the filler pieces can withstand centrifugal loads. The filler pieces 130 are also sized and configured to fit through the neck 16 of the slot 14. Their length $L_F$ further sized so that they may be inserted into the slot 14 when the replacement blade element 110 is in place. As shown in FIG. 5, the length $L_B$ of the replacement blade element 110 is less than the length of the slot 14. There is thus space at either end of the slot 14 for insertion of the filler pieces through the slot neck 16. Once inserted into the slot 14, the filler pieces may be positioned against the slot flanks 34 and moved along the slot axis 30 into position between the slot flanks 34 and the replacement blade base 114.

Figure 12:
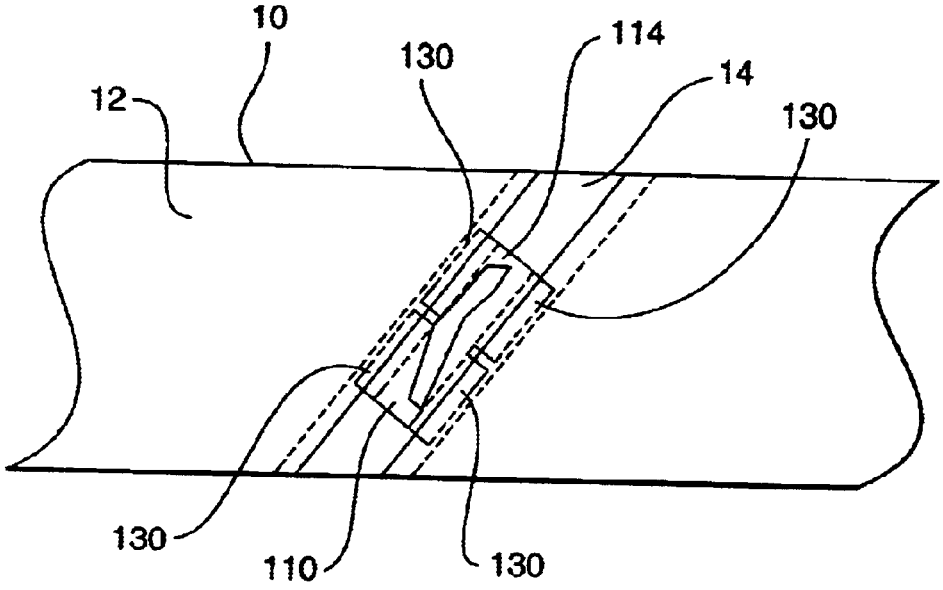
FIG. 12 is a radial view of a portion of a compressor wheel having a replacement blade assembly according to the present invention installed therein.

The slot length on either end of the replacement blade element 110 may limit the length of the filler pieces 130 that may be inserted into the slot 14. In certain instances, it may therefore be necessary to use multiple shorter filler pieces 130 as shown in FIG. 12. It will be understood by those of ordinary skill in the art that the number of filler pieces 130 is limited only by the practical difficulties of inserting and positioning very small filler pieces 130. The total length of the combined filler pieces 130 on either side of the replacement blade element 110 is preferably the same as the length of the replacement blade element base 114.

When the replacement blade assembly is installed on a rotor that has not been disassembled, the overall limiting length for the combined replacement blade element 110 and a filler piece 130 is the distance along the slot axis between the rotor wheels on either side of the wheel 10 on which the replacement blade is to be installed. For ease of installation, however, it is preferred that the filler pieces 130 be sized so as to allow insertion at either end of the slot 14 with the replacement blade element 110 positioned approximately at the lengthwise center of the slot 14.

Figure 13:
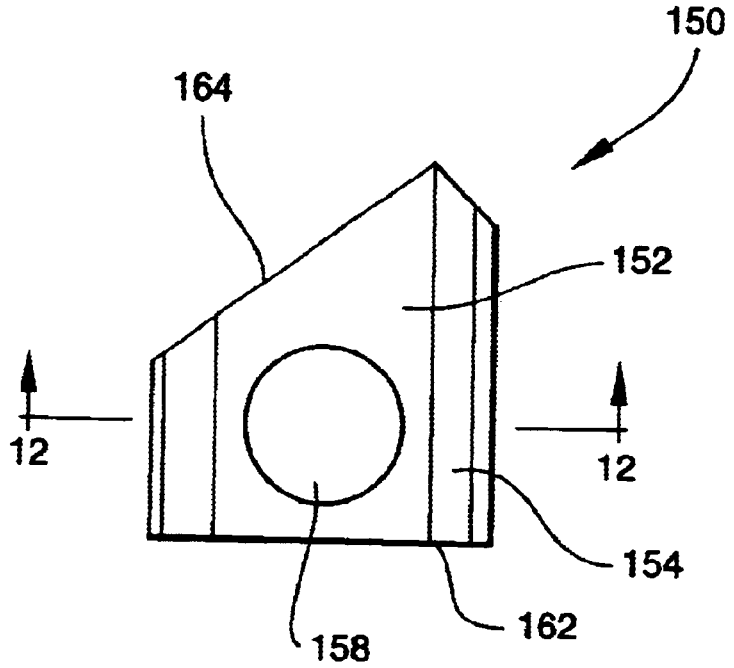
FIG. 13 is a top view of a spacer of a replacement blade assembly according to the invention.
Figure 14:
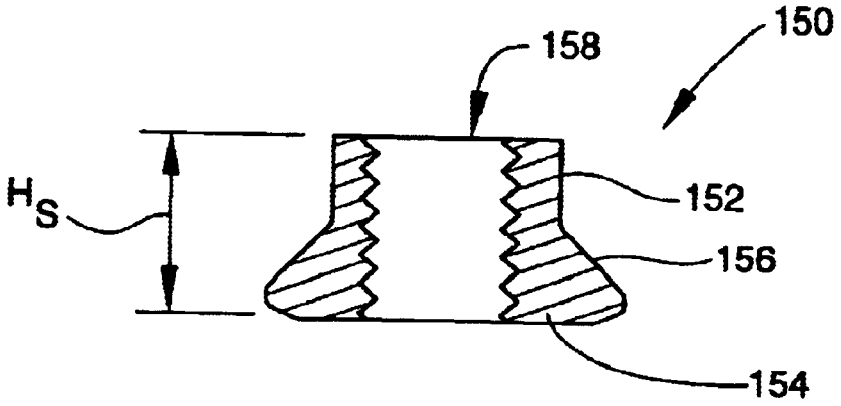
FIG. 14 is a section view of the spacer illustrated in FIG. 13.
Figure 17:
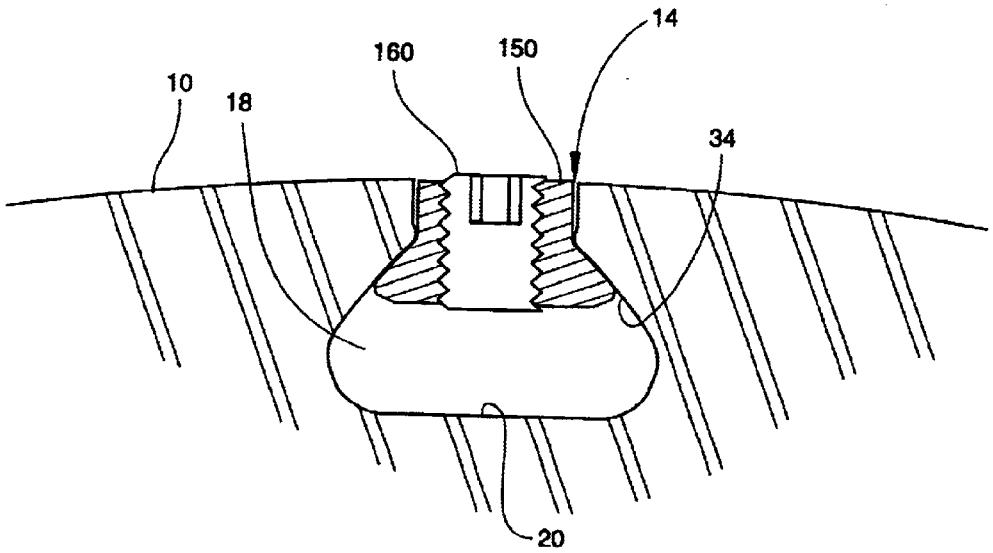
FIG. 17 is a section view of the compressor wheel and spacer illustrated in FIG. 15 with the spacer in a final position within the slot of the compressor wheel.
Figure 18:
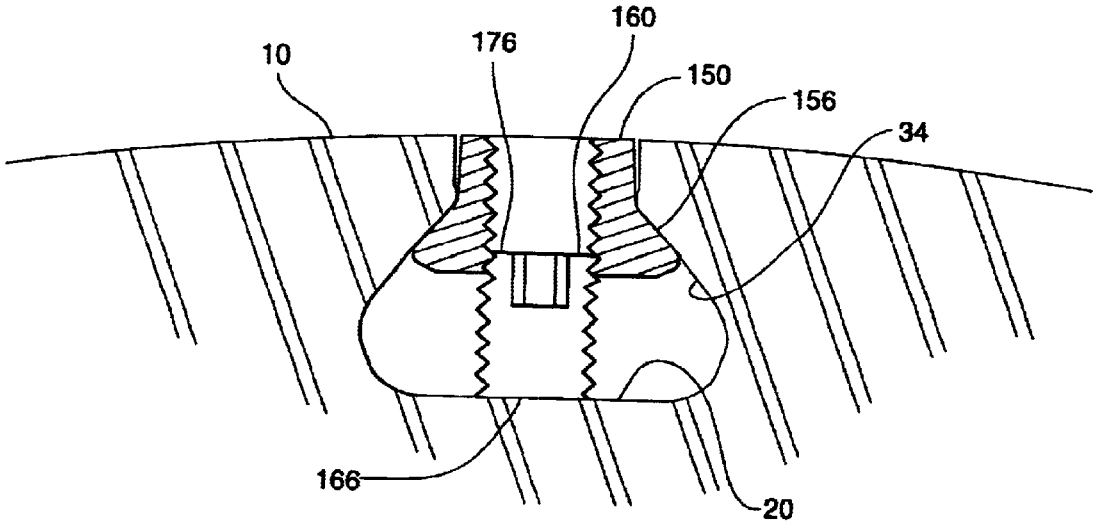
FIG. 18 is a section view of the compressor wheel and spacer illustrated in FIG. 15 with the spacer secured in place within the slot.

The replacement blade element 10 and the filler pieces 130 are held in position along the slot axis 30 by spacers 150. FIGS. 13 and 14 illustrate a spacer 150 according to one aspect of the invention. The spacer 150 has a neck portion 152 and a dovetail portion 154 with flanks 156 configured for positioning against the flanks 34 of the base cavity 18 as shown in FIG. 17. The spacer 150 includes a threaded passage 158 in which a threaded fastener such as a grub screw 160 is disposed. The grub screw 160 has a proximal end 176 with a keyway 168 and a distal end 166. The keyway 168 is formed to accept a hex key or a screwdriver or other tool to facilitate rotation of the screw. The distal end 166 is formed so as to contact the floor 20 of the slot 14. When tightened against the floor 20 as shown in FIG. 18, the grub screw 160 forces the spacer dovetail flanks 156 against the slot flanks 34 to hold the spacer 150 in place.

The spacers 150 may be made from aluminum, steel, a nickel alloy, a titanium alloy or other suitable material. It will be understood that the dovetail portion 154 of the spacers 150 may be smaller than the dovetail 44 of the original blade element 40. This is because the spacers 150 lack an airfoil portion and thus will experience lower aerodynamic and centrifugal loads. Conventional design methods similar to those discussed above may be used to determine the optimum size of the spacers 150 taking into account both the loads that must be countered and the geometry constraints due to the insertion approach discussed below.

As shown in FIG. 5, the spacers 150 are positioned against the ends of the replacement blade element base 114 and the outermost filler pieces 130 to hold the replacement blade element 110 and the filler pieces 130 in place. As shown in FIGS. 5 and 13, the end 162 of the spacer 150 that abuts the blade element base 114 and the filler pieces 130 is substantially perpendicular to the slot axis 30 while the opposite end 164 of the spacer 150 is angled so as to be substantially coplanar with the side of the wheel 10 when the spacer 150 is installed.

Figure 15:
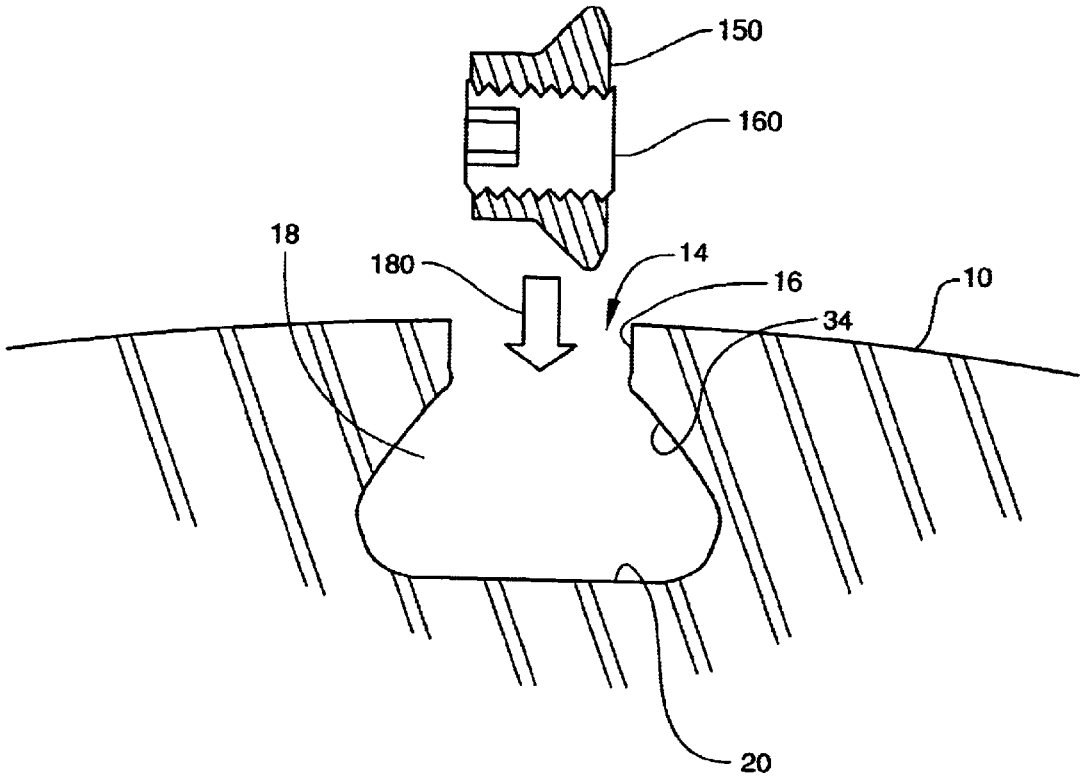
FIG. 15 is a section view of a portion of a compressor wheel and the spacer of FIG. 13.
Figure 16:
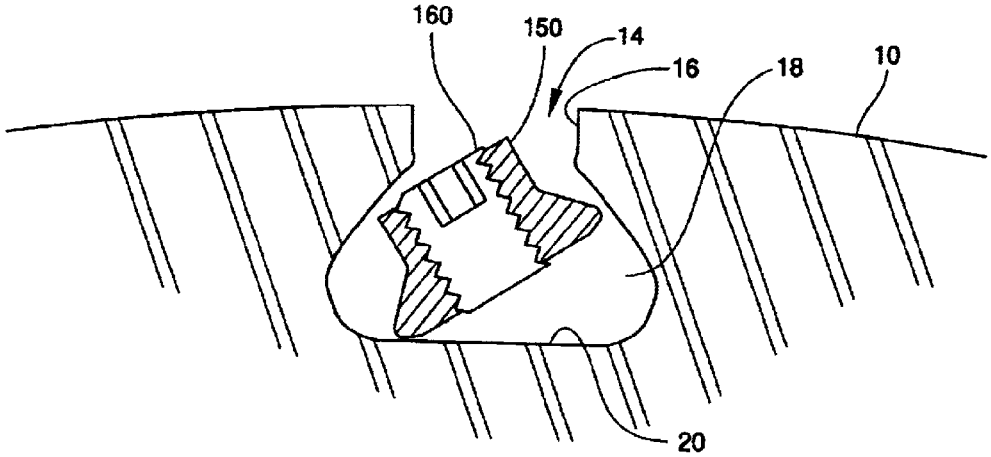
FIG. 16 is a section view of the compressor wheel and spacer illustrated in FIG. 15 with the spacer inserted in a slot in the compressor wheel.

The spacer 150 is sized to allow the sideways insertion and rotation of the spacer 150 into the slot 14 as shown in FIGS. 15–17. In particular, the height $H_S$ of the spacer 150 is less than the width of the slot neck 16 so that the spacer 150 may be inserted through the neck 16 when rotated as shown in FIG. 15. The spacer height $H_S$ must also be small enough that the spacer 150 may be rotated within the slot dovetail 18 as shown in FIG. 16.

Thus, to install the spacer 150, the spacer is first positioned as shown in FIG. 15. The spacer 150 is inserted into the slot 14 by translation through the neck as illustrated by the arrow 180. Once within the slot dovetail 18, the spacer 150 is rotated through the position shown in FIG. 16 to a position where it can be translated radially upward to the position shown in FIG. 17. The grub screw 160 can then be tightened to hold the spacer 150 in place as shown in FIG. 18.

In a method of replacing a blade element 40 according to an embodiment of the invention, the blade element 40 is removed from the slot 14 as previously discussed. The replacement blade element 110 is then positioned by inserting its base portion 114 into the slot 14 through the neck portion 16 of the slot 14. Filler pieces 130 are then inserted through the neck portion 16 of the slot 14 in the slot areas not occupied by the replacement blade element base 114. The filler pieces 130 are then positioned against the slot flanks 34 and moved along the slot axis 30 into position between the replacement blade element base 114 and the slot flanks 34. The spacers 150 are then inserted into the slot 14 through the neck portion 16 of the slot 14 in the areas not occupied by the replacement blade element base 114 and the filler pieces 130. The spacers 150 are then rotated and translated so that the spacer dovetail flanks 156 contact the flanks 34 of the slot 14 and so that the perpendicular end 162 of each spacer 150 abuts the replacement blade element base 110 and the outermost filler pieces 130. A grub screw 160 having a keyway 168 for accommodating a hex key, screwdriver or similar tool is then threaded into each spacer 150. The grub screws 160 are then tightened against the floor 20 of the slot 14 to force the spacers 150 upward against the slot flanks 34.

Figure 19:
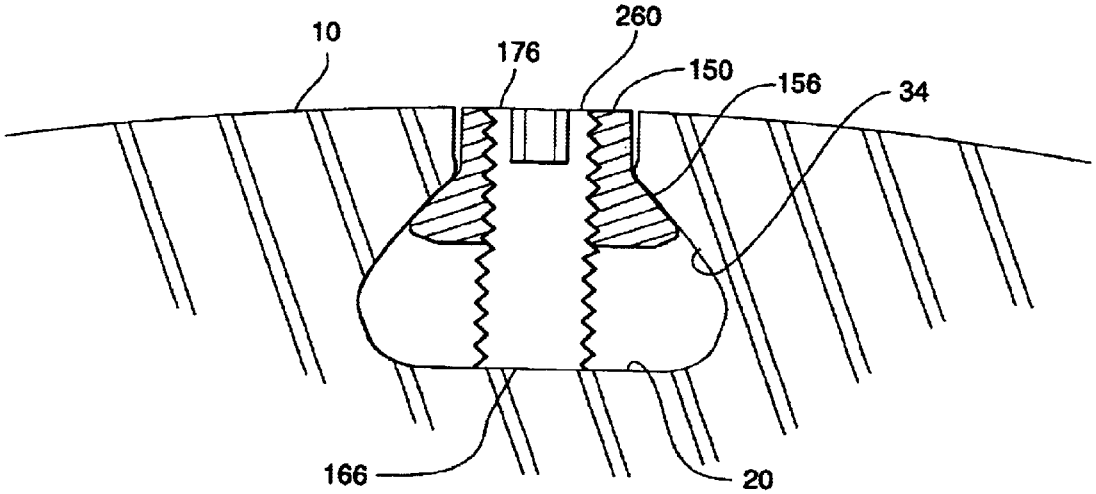
FIG. 19 is a section of a portion of a compressor wheel with a spacer according to the invention secured in place within a slot of the compressor wheel.

It will be understood that, depending on the relative dimensions involved, it may be possible in the above method to insert the filler pieces 130 before the replacement blade element base 114 is positioned in the slot 14. It will also be understood that the spacers 150 may be inserted into the slot with or without the grub screws 160 threaded to the spacers 150. Insertion without the grub screw 160 allows the use of a longer grub screw 260 that can be threaded into the spacer 150 after it is in place. As shown in FIG. 19, this allows the sizing of the grub screw 260 so that its proximal end 176 is nearly flush with the upper surface of the spacer 150 when tightened.

Figure 20:
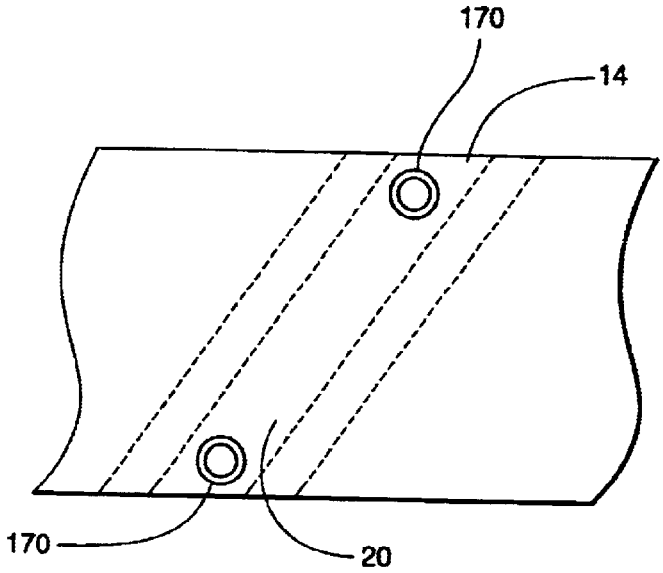
FIG. 20 is a radial view of a portion of a compressor wheel illustrating a slot having a pair of depressions machined therein.
Figure 21:
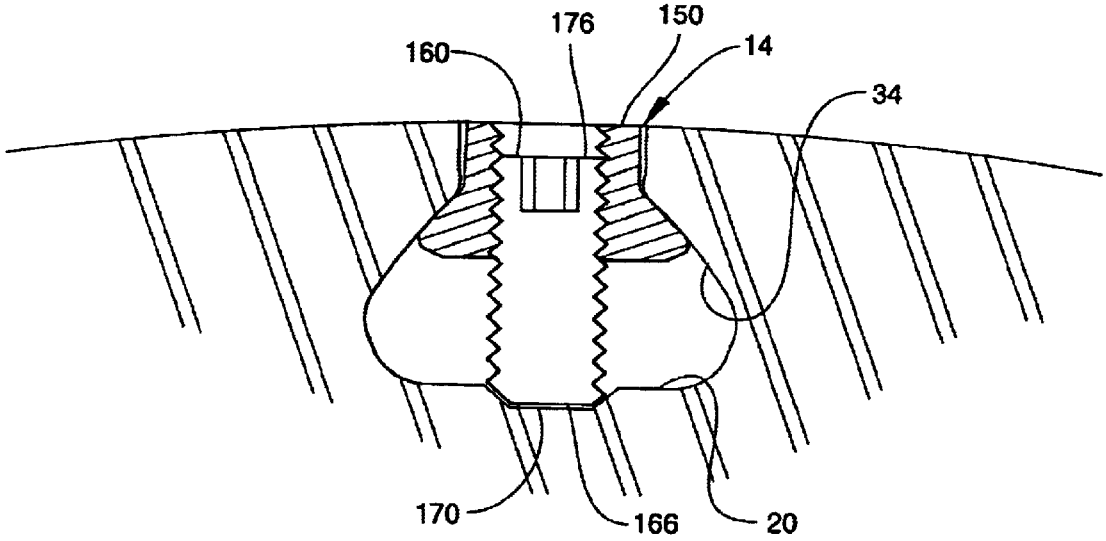
FIG. 21 is a section view of the compressor wheel illustrated in FIG. 20, the compressor wheel having a spacer secured within the slot.

A further aspect of the invention provides an additional step to the blade replacement method wherein two depressions 170 are machined into the floor 20 of the slot 14 (see FIG. 20) prior to insertion of the spacers 150. These depressions 170 would be positioned so as to provide a seat for the distal ends 166 of the grub screws 160 when the grub screws 160 are threaded through the spacers 150 to contact the slot floor 20 (see FIG. 21). Seating the screws 160 in the depressions 170 would serve to assure that the spacers 150 are properly positioned and secured in place.

With the replacement blade in place, the rotor may be returned to service. If desired, the rotor may be rebalanced using standard balancing weights. In some instances, it may be desirable to replace a diametrically opposing blade element on the rotor wheel 10 in order to assure that the wheel is balanced.

Although the illustrated embodiments of the invention include a symmetric blade element base secured by mirror image filler pieces, it will be understood that alternative embodiments of the invention may include an asymmetric blade element base. In particular, a replacement blade system of the invention could include a base portion configured to be pressed against one flank of a dovetail-shaped slot by one or more filler pieces configured to fit between the blade element base and the opposite flank of the slot. Both the blade element base and the filler pieces would still be sized and configured for insertion through the neck 16 of the slot 14. This approach would reduce the number of filler pieces required because they would only be required on one side of the blade element base.

It will also be understood by those having ordinary skill in the art that the replacement blade systems of the present invention may be used in any turbine or compressor wheel having blade elements secured using a slot formed in the rim of the wheel. This includes wheels wherein the slot is formed across the rim of the wheel and wheels wherein the slot is formed circumferentially around the wheel.

The present invention is highly advantageous in that it allows the replacement of monolithic rotor blade elements in the field on existing machinery. However, the blade element assembly of the present invention could also be used in the manufacture of new rotor wheels. The blade elements on these wheels could be easily removed by reversing the installation steps of the method. Accordingly, blades requiring replacement due to FOD could be easily replaced in the field without the necessity of destructive removal of the damaged blade.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. A blade assembly for installation in a rotor wheel slot having a slot neck in communication with a slot base cavity having first and second slot flank walls and a slot floor, the blade assembly comprising:

a blade element having an airfoil portion and a base portion configured for insertion into the rotor wheel slot through the slot neck; and at least one filler piece configured for insertion into the rotor wheel slot through the slot neck and for positioning intermediate the base portion and the first slot flank wall to secure the base portion within the rotor wheel slot, the at least one filler piece having a filler piece length dimension, said filler piece being configured to transmit a radial load from the base portion to the first slot flank wall.

2. A blade assembly according to claim 1 wherein the base portion of the blade element includes a base dovetail having first and second dovetail flank surfaces and a dovetail bottom surface and wherein the blade assembly comprises a first filler piece configured to be positionable with at least a portion of the first filler piece disposed intermediate the first dovetail flank surface and the first slot flank wall and a second filler piece configured so that at least a portion of the second filler piece is disposable intermediate the second dovetail flank surface and the second slot flank wall.

3. A blade assembly according to claim 2 wherein the at least a portion of the first filler piece includes a first engaging surface adapted for engaging the first slot flank wall and a second engaging surface adapted for engaging the first dovetail flank surface and wherein the at least a portion of the second filler piece includes a third engaging surface adapted for engaging the second slot flank wall and a fourth engaging surface adapted for engaging the second dovetail flank surface.

4. A blade assembly according to claim 2 wherein the first and second filler pieces each include a bottom member configured so that the bottom member is disposed intermediate the dovetail bottom surface and the slot floor.

5. A blade assembly according to claim 4 wherein at least a portion of the bottom member is configured to engage the dovetail bottom surface and the slot floor.

6. A blade assembly according to claim 1 wherein the base portion of the blade element includes a base dovetail having first and second dovetail flank surfaces and a dovetail bottom surface and wherein the blade assembly comprises a first plurality of filler pieces sized and configured to be positionable with at least a portion of each of the first plurality of filler pieces disposed intermediate the first dovetail flank surface and the first slot flank wall and a second plurality of filler pieces sized and configured to be positionable with at least a portion of each of the second plurality of filler pieces disposed intermediate the second dovetail flank surface and the second slot flank wall.

7. A blade assembly according to claim 6 wherein the at least a portion of each of the first plurality of filler pieces includes a first engaging surface adapted for engaging the first slot flank wall and a second engaging surface adapted for engaging the first dovetail flank surface and wherein the at least a portion of each of the second plurality of filler pieces includes a third engaging surface adapted for engaging the second slot flank wall and a fourth engaging surface adapted for engaging the second dovetail flank surface.

8. A blade assembly according to claim 6 wherein each of the first and second plurality of filler pieces includes a bottom member configured so that the bottom member is disposed intermediate the dovetail bottom surface and the slot floor.

9. A blade assembly according to claim 8 wherein at least a portion of the bottom member is configured to engage the dovetail bottom surface and the slot floor.

10. A blade assembly according to claim 1 further comprising:

a spacer configured for insertion into the rotor wheel slot through the slot neck and for positioning within the rotor wheel slot in abutment with the base portion of the blade element, the spacer having a spacer base with first and second spacer flank surfaces configured for engagement with the first and second slot flank walls.

11. A blade assembly according to claim 10 further comprising means for securing the spacer in place within the rotor wheel slot.

12. A blade assembly according to claim 11 wherein the means for securing the spacer includes a threaded fastener having proximal and distal ends, the threaded fastener being configured for insertion through a corresponding threaded passage in the spacer so that the distal end contacts the slot floor.

13. A blade assembly for installation on a rotor wheel having a blade slot formed in a circumferential rim thereof, the blade slot having a substantially constant cross-section with a slot neck in communication with a slot base cavity having first and second flank surfaces and a floor, the blade assembly comprising:

a blade element having an airfoil portion and a base portion having first and second base flank surfaces and a base bottom surface and being configured for insertion into the blade slot through the slot neck;

a first filler piece configured to be positionable with at least a portion of the first filler piece disposed intermediate the first base flank surface and the first slot flank wall; and a second filler piece configured so that at least a portion of the second filler piece is disposable intermediate the second base flank surface and the second slot flank wall.

14. A blade assembly according to claim 13 wherein the base cavity and the base portion of the blade element are substantially dovetail-shaped.

15. A blade assembly according to claim 13 wherein the at least a portion of the first filler piece includes a first engaging surface adapted for engaging the first slot flank wall and a second engaging surface adapted for engaging the first base flank surface and wherein the at least a portion of the second filler piece includes a third engaging surface adapted for engaging the second slot flank wall and a fourth engaging surface adapted for engaging the second base flank surface.

16. A blade assembly according to claim 13 wherein the first and second filler pieces each include a bottom member configured so that the bottom member is disposable intermediate the base bottom surface and the slot floor.

17. A blade assembly according to claim 16 wherein at least a portion of the bottom member is configured to engage the base bottom surface and the slot floor.

18. A blade assembly according to claim 13 further comprising:

a spacer configured for insertion into the blade slot through the slot neck and for positioning within the blade slot in abutment with the base portion of the blade element, the spacer having a spacer base with first and second spacer flank surfaces configured for engagement with the first and second slot flank walls; and means for securing the spacer in place within the blade slot.

19. A blade assembly for installation on a rotor wheel having a blade slot formed in a circumferential rim thereof, the blade slot having a substantially constant cross-section with a slot neck in communication with a dovetail-shaped base cavity defined by first and second flank surfaces and a floor, the blade assembly comprising:

a blade element having an airfoil portion and an elongate base portion including a base dovetail having first and second dovetail flank surfaces and a dovetail bottom surface and being configured for insertion into the blade slot through the slot neck; and a first plurality of filler pieces sized and configured to be positionable with at least a portion of each of the first plurality of filler pieces disposed intermediate the first dovetail flank surface and the first slot flank wall; and a second plurality of filler pieces sized and configured to be positionable with at least a portion of each of the second plurality of filler pieces disposed intermediate the second dovetail flank surface and the second slot flank wall.

20. A blade assembly according to claim 19 wherein the at least a portion of each of the first plurality of filler pieces includes a first engaging surface adapted for engaging the first slot flank wall and a second engaging surface adapted for engaging the first dovetail flank surface and wherein the at least a portion of each of the second plurality of filler pieces includes a third engaging surface adapted for engaging the second slot flank wall and a fourth engaging surface adapted for engaging the second dovetail flank surface.

21. A blade assembly according to claim 20 wherein each of the first and second plurality of filler pieces includes a bottom member configured so that the bottom member is disposed intermediate the dovetail bottom surface and the slot floor.

22. A blade assembly according to claim 21 wherein at least a portion of the bottom member is configured to engage the dovetail bottom surface and the slot floor.

23. A blade assembly according to claim 19 further comprising:

a spacer configured for insertion into the blade slot through the slot neck and for positioning within the blade slot in abutment with the base portion of the blade element, the spacer having a spacer dovetail with first and second spacer flank surfaces configured for engagement with the first and second slot flank walls; and means for securing the spacer in place within the blade slot.

24. A method of replacing a blade element installed on a rotor wheel having a blade slot formed in a circumferential rim thereof, the blade slot having a substantially constant cross-section with a slot neck in communication with a base cavity having first and second slot flank walls and a slot floor, the blade element having an airfoil portion and a blade element base portion disposed within the blade slot, the method comprising:

removing the blade element from the blade slot;

providing a replacement blade element having a replacement blade airfoil portion and a replacement blade element base portion configured for insertion into the blade slot through the slot neck and having opposing first and second base ends;

inserting the replacement blade element base portion into the blade slot through the slot neck;

providing at least one filler piece configured for insertion into the blade slot through the slot neck and for positioning intermediate the replacement blade element base portion and the first slot flank wall for securing the replacement blade element base portion within the blade slot;

inserting a first one of the at least one filler piece through the slot neck into the blade slot adjacent one of the first and second base ends; positioning the first one of the at least one filler piece against the first slot flank wall; and sliding the first one of the at least one filler piece along the first slot flank wall to a position wherein the first one of the at least one filler piece is disposed intermediate the replacement blade element base portion and the first slot flank wall.

25. A method according to claim 24 further comprising:

inserting a second one of the at least one filler piece through the slot neck into the blade slot adjacent one of the first and second base ends;

positioning the second one of the at least one filler piece against the second slot flank wall; and sliding the second one of the at least one filler piece along the second slot flank wall to a position wherein the second one of the at least one filler piece is disposed intermediate the replacement blade element base portion and the first slot flank wall.

26. A method according to claim 24 further comprising:

providing a first spacer configured for insertion into the blade slot through the slot neck and for positioning within the blade slot in abutment with the base portion of the blade element, the first spacer having a first spacer base with first and second spacer flank surfaces configured for engagement with the first and second slot flank walls and a first spacer abutment surface configured for engaging the first base end;

providing means for securing the first spacer in place within the blade slot; inserting the first spacer through the slot neck into the blade slot adjacent the first base end;

positioning the first spacer within the blade slot so that the first spacer flank surface engages the first slot flank wall, the second spacer flank engages the second slot flank wall, and the first spacer abutment surface engages the first base end; and securing the first spacer in position using the means for securing the first spacer.

27. A method according to claim 26 wherein the means for securing the first spacer includes a threaded fastener disposed through a corresponding threaded passage in the first spacer so that rotation of the threaded fastener causes an end of the threaded fastener to engage the slot floor and force the first spacer radially outward.

28. A method according to claim 27 further comprising the step of machining a depression in the slot floor to provide a seat for the threaded fastener end.

29. A method according to claim 26 further comprising:

providing a second spacer configured for insertion into the blade slot through the slot neck and for positioning within the blade slot in abutment with the base portion of the blade element, the second spacer having a second spacer base with third and fourth spacer flank surfaces configured for engagement with the first and second slot flank walls and a second spacer abutment surface configured for engaging the second base end;

providing means for securing the second spacer in place within the blade slot;

inserting the second spacer through the slot neck into the blade slot adjacent the second base end;

positioning the second spacer within the blade slot so that the third spacer flank surface engages the first slot flank wall, the fourth spacer flank engages the second slot flank wall, and the second spacer abutment surface engages the second base end; and securing the second spacer in position using the means for securing the second spacer.

30. A method according to claim 24 wherein the step of removing the blade element includes:

removing the airfoil portion of the blade element; grinding out a central portion of the blade element base portion through the slot neck to leave two lateral portions of the blade element base portion in the slot dovetail; and removing the two lateral portions of the blade element base portion from the blade slot through the slot neck.

31. A method of replacing a blade element installed on a rotor wheel having a blade slot formed in a circumferential rim thereof, the blade slot having a substantially constant cross-section with a slot neck in communication with a slot base cavity defined by first and second slot flank walls and a slot floor, the blade element having an airfoil portion and a blade element base portion being disposed within the blade slot, the method comprising:

removing the airfoil portion of the blade element;

grinding out a central portion of the blade element base through the slot neck to leave two lateral portions of the blade element base portion in the slot dovetail;

removing the two lateral portions of the blade element base portion from the blade slot through the slot neck;

providing a replacement blade element having a replacement blade airfoil portion and a replacement blade element base portion configured for insertion into the blade slot through the slot neck and having opposing first and second base ends;

inserting the replacement blade element base portion into the blade slot through the slot neck;

providing at least one filler piece configured for insertion into the blade slot through the slot neck and for positioning intermediate the replacement blade element base portion and the first slot flank wall for securing the replacement blade element base portion within the blade slot;

inserting a first one of the at least one filler piece through the slot neck into the blade slot adjacent one of the first and second base ends;

positioning the first one of the at least one filler piece against the first slot flank wall;

sliding the at least one filler piece along the first slot flank wall to a position wherein the at least one filler piece is disposed intermediate the replacement blade element base portion and the first slot flank wall;

inserting a second one of the at least one filler piece through the slot neck into the blade slot adjacent one of the first and second base ends;

positioning the second one of the at least one filler piece against the second slot flank wall; and sliding the at least one filler piece along the second slot flank wall to a position wherein the at least one filler piece is disposed intermediate the replacement blade element base portion and the first slot flank wall.

32. A method according to claim 31 further comprising:

providing a first spacer configured for insertion into the blade slot through the slot neck and for positioning within the blade slot in abutment with the base portion of the blade element, the first spacer having a first spacer base with first and second spacer flank surfaces configured for engagement with the first and second slot flank walls and a first spacer abutment surface configured for engaging the first base end;

providing means for securing the first spacer in place within the blade slot;

inserting the first spacer through the slot neck into the blade slot adjacent the first base end;

positioning the first spacer within the blade slot so that the first spacer flank surface engages the first slot flank wall, the second spacer flank engages the second slot flank wall, and the first spacer abutment surface engages the first base end;

securing the first spacer in position using the means for securing the first spacer;

providing a second spacer configured for insertion into the blade slot through the slot neck and for positioning within the blade slot in abutment with the base portion of the blade element, the second spacer having a second spacer base with third and fourth spacer flank surfaces configured for engagement with the first and second slot flank walls and a second spacer abutment surface configured for engaging the second base end; providing means for securing the second spacer in place within the blade slot;

inserting the second spacer through the slot neck into the blade slot adjacent the second base end;

positioning the second spacer within the blade slot so that the third spacer flank surface engages the first slot flank wall, the fourth spacer flank engages the second slot flank wall, and the second spacer abutment surface engages the second base end; and securing the second spacer in position using the means for securing the second spacer.

* * * * *